United States Patent [19]

Ogihara et al.

[11] 4,212,155

[45] Jul. 15, 1980

[54] TIME DETECTING SWITCH FOR CLOCK

[75] Inventors: Masuo Ogihara; Kozo Chimura; Nobuo Shinozaki, all of Shikawatashi, Japan

[73] Assignee: Seiko Koki Kabushiki Kaisha, Tokyo, Japan

[21] Appl. No.: 908,556

[22] Filed: May 22, 1978

[30] Foreign Application Priority Data

May 23, 1977 [JP] Japan ..... 52-66689[U]

[51] Int. Cl.[2] ..... G04B 23/10; G04C 21/16

[52] U.S. Cl. ..... 368/250; 368/72

[58] Field of Search ..... 58/16 R, 16 D, 19 R, 58/19 A, 22.5, 22.7, 38 R, 38 A, 152 B, 125 R, 125 B, 126 R, 126 A

[56] References Cited

U.S. PATENT DOCUMENTS

| | | | |
|---|---|---|---|
| 2,611,232 | 9/1952 | Wuischpard | 58/19 R |
| 2,651,166 | 9/1953 | Dorfman | 58/19 R |
| 2,709,331 | 5/1955 | Lehner | 58/19 R |
| 3,611,702 | 10/1971 | Spadini | 58/19 R |
| 3,686,879 | 8/1972 | Hummel et al. | 58/38 R |
| 3,996,734 | 12/1976 | Kitai et al. | 58/38 R |
| 4,015,417 | 4/1977 | Kitai et al. | 58/50 R |

*Primary Examiner*—Vit W. Miska

*Attorney, Agent, or Firm*—Robert E. Burns; Emmanuel J. Lobato; Bruce L. Adams

[57] ABSTRACT

A time detecting switch for a time signalling clock having a time wheel and detecting wheel both rotatably mounted coaxially and a phase detecting type slide switch between the time wheel and the detecting wheel comprises one of the wheels comprising an electrically conductive hub having a flange with a radial contacting surface at one end of the hub, an insulating disc and a sectoral switch plate around the hub, the disc being sandwiched between the plate and the flange with the plate being mechanically and electrically connected to the other end portion of the hub facing the other wheel. The other wheel has a sliding contact for contacting the sectoral plate and the radial contacting surface of the flange is capable of maintaining uninterrupted continuous sliding contact with the signalling circuit of the clock.

7 Claims, 7 Drawing Figures

TIME DETECTING SWITCH FOR CLOCK

BACKGROUND OF THE INVENTION

This invention relates to a mechanism of a time detecting device for a clock having an electric alarm signaling device which is actuated at the predetermined alarm signaling time.

The essential mechanism of the conventional time detecting device for an alarm clock is a drop-in type mechanism constituted of a hole and projection provided for a time detecting wheel and a corresponding time wheel rotating at a fixed rate, respectively.

This mechanism has a disadvantage that the alarm signaling time setting knob or the time indication adjusting knob can be rotated only in one direction in alarm signaling time setting or in time indication adjusting because the wall of the hole and the side face of the projection are shaped vertically straight with each other so as to make the projection drop into the hole instantaneously to attain accurate time detection. A further disadvantage of this conventional mechanism is that the electromechanical transducer is undesirably loaded when the projection escapes out of the hole along the inclined wall of the hole in accordance with rotation of the wheels.

SUMMARY OF THE INVENTION

In order to overcome those disadvantages, the detecting device according to this invention is provided with a phase detecting type slide contact switch which is more simple in fabrication and less costly.

The object of the invention is attained by providing a phase detecting type slide contact switch comprising a time wheel or a detecting wheel having a stepped boss made of electric conductive material, a part of said stepped boss being in sliding contact with a contact piece of the alarm signaling circuit, an insulating plate and a sectoral switch plate fixedly fitted on the stepped part of said boss so as to electrically connect the electric conductive boss and the sectoral switch plate.

The detailed mechanism will become more fully apparent as reference to the accompanying drawings, wherein the invention is illustrated.

DETAILED DESCRIPTION OF THE PREFERRED EMBODIMENTS

Figure 1:
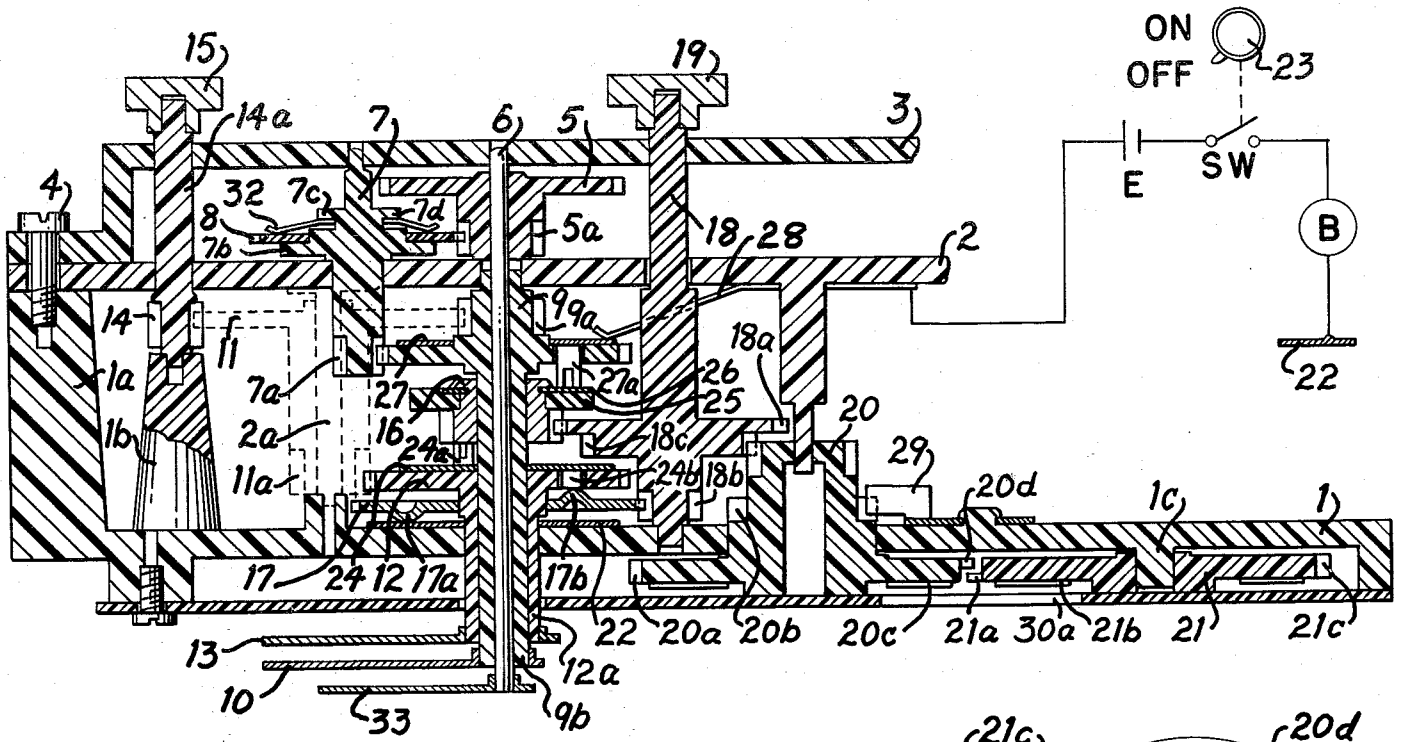
FIG. 1 is a sectional view of a first embodiment according to the present invention.

Referring to FIGS. 1 to 6 inclusive, explanation will be made on the construction of the first embodiment.

A case (1) made of plastics has a projection (1*a*) having a tapped hole at its left end, holes for rotatably guiding the tubular boss (12*a*) of a time wheel (12) and an alarm signaling time setting wheel (18) and bosses for rotatably receiving the shaft of a time indication adjusting wheel (14) and for receiving a stud shaft (2*a*) for mounting an intermediate hour wheel (11).

A middle frame (2) made of plastics has holes for rotatably guiding an intermediate spindle (7) and the boss of a minute wheel (9), idle holes through which the shafts of the alarm signaling time setting wheel (18) and the time indication adjusting wheel (14) pass and the stud shaft (2*a*) made in a body with the middle frame (2) for rotatably guiding the intermediate hour wheel (11). A cover (3) also made of plastics has holes for rotatably guiding the shaft (6) of a second wheel, the intermediate spindle (7), the shaft (14*a*) of the time indication adjusting wheel and the alarm signaling time setting wheel (18).

The middle frame (2) and the cover (3) are fastened to the case (1) at the projection (1*a*) by means of screws (4).

The following explanation is concerned with the construction of a gear train for the time indicating mechanism.

A second wheel (5) and a pinion (5*a*) made of plastics in a body are fixed to the shaft (6) being rotatably guided in the hole on the cover (3) and through the tubular boss (9*b*) of the minute wheel and fixedly provided with the minute hand (10) at the end.

The second wheel (5) is driven by a motor, a step motor for instance, not shown. The intermediate shaft (7) made of plastics comprises in a body a pinion (7*a*) at the bottom end, a first flange (7*b*), a groove (7*c*) and a second flange (7*d*). The intermediate shaft (7) is rotatably guided in the hole on the cover (3) at the upper end and in the hole on the middle frame (2) at the middle part.

An intermediate wheel (8) engaging with the pinion (5*a*) of the second wheel (5) is rotatably fitted to the intermediate shaft (7) on the first flange (7*b*) and pressed thereto by a leaf spring (32) having one end retained by the second flange (7*d*) so that the intermediate wheel (8) and the intermediate shaft (7) are frictionally coupled.

The minute wheel (9) engaging with the pinion (7*a*) of the intermediate shaft (7) is made of plastics in a body with a pinion (9*a*) and a tubular boss (9*b*). One end of the tubular boss (9*b*) is rotatably received in the hole on the middle frame (2) and the other end is rotatably guided through a tubular boss (12*a*) of the hour wheel and fixedly provided with the minute hand (10) at the tip. The intermediate hour wheel (11) engaging with the pinion (9*a*) of the minute wheel is made of plastics in a body with a pinion (11*a*) and rotatably fitted on the stud shaft (2*a*) of the middle frame (2). The hour wheel (12) engaging with the pinion (11*a*) is made of plastics in a body with the tubular boss (12*a*) rotatably guiding the tubular boss (9*b*) of the minute wheel through the bore and being rotatably received through the hole on the case (1) and fixedly provided with the hour hand (13) at the tip. The time indication adjusting wheel (14) also is engaged with the intermediate hour wheel (11). The time indication adjusting wheel (14) and its shaft (14*a*) are made of plastics in a body. The bottom end of the shaft (14*a*) is rotatably received in the hole on the projection (1*b*) of the case (1) and the other end penetrating through the idle hole on the middle frame (2) is rotatably guided by the hole on the cover (3) and fixedly provided with a knob (15) at the projecting end.

The following explanation is concerned with the construction of a gear train for the alarm signaling mechanism.

A minute detecting wheel (16) made of electric conductive material is rotatably fitted on the tubular boss of the minute wheel (9*a*) between the minute wheel (9) and the hour wheel (12). An hour detecting wheel (17) made of electric conductive material is disposed directly under the hour wheel (12) and rotatably fitted on the tubular boss (12*a*) of the hour wheel (12). An alarm signaling time setting wheel (18) of a compound wheel is made of plastics in a body with a first pinion (18*a*) engaging with the minute detecting wheel (16), a second pinion (18*b*) engaging with the hour detecting wheel (17) and a third pinion (18*c*). On the upper end of the alarm signaling time setting wheel (18) projecting through the cover (3), there is fixed a knob (19) to facilitate alarm signaling time setting operation.

The third pinion (18*c*) is engaged with a minute alarm signaling time indicating wheel (20) rotatably guided by the case (1).

Figure 2:
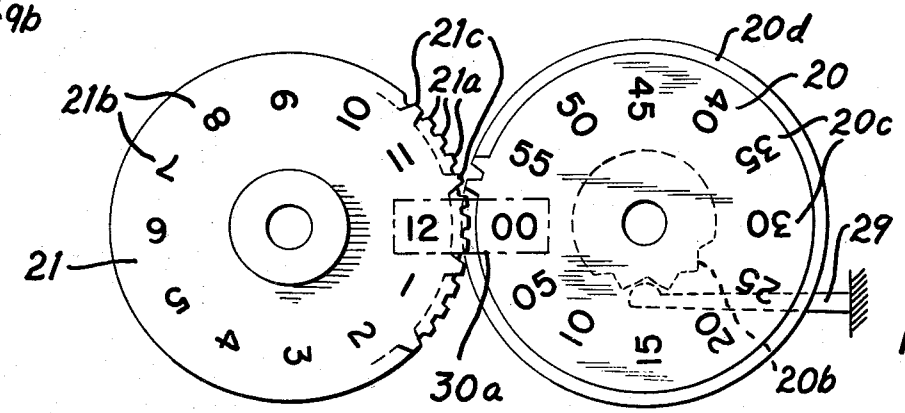
FIGS. 2, 3, 4 and 5 are partial plan views of FIG. 1.

A further explanation will be made on the alarm signaling mechanism referring particularly to FIGS. 1 and 2.

The minute alarm signaling time indicating wheel (20) is constituted of a disk (20*d*) having place advancing teeth (20*a*) and stepped part (20), minute alarm signaling time marks (20*c*) marked on the front face of the disk (20*d*) so as to be able to be seen through an alarm signaling time indicating opening (30*a*) and a locking wheel (20 *b*), shown by dotted lines (FIG. 2), engaging with a click-stopping spring (29) fixed to the case (1) at one end. The number of teeth of the locking wheel (20*b*) corresponds to the number of minute marks (20*c*), therefore, the minute alarm signaling time indicating wheel (20) is click-stopped at every minute mark. An hour alarm signaling time indicating wheel (21) is rotatably fitted on a stud (1*c*) of the case (1). The hour alarm signaling time indicating wheel (21) has a gear (21*a*) engaging with the place advancing teeth (20*a*) of the minute alarm signaling time indicating wheel (20) and a lost toothed gear (21*c*) related with the disk (20*d*) of the minute alarm signaling time indicating wheel and provided with hour alarm signaling time marks (21*b*) on the front face. Normally, the hour alarm signaling time indicating wheel (21) is constrained by the engagement of the lost toothed gear (21*c*) with the disk (20*d*). When the disk (20*d*) rotates changing the minute mark from 55 minutes to 00 minute or from 00 minute to 55 minutes, the hour alarm signaling time indicating wheel (21) is turned 30 degrees corresponding to the pitch of the hour alarm signaling time marks by the place advancing teeth (20*a*).

The following explanation is concerned with the construction of the detecting switch for detecting alarm signaling time.

One terminal of a buzzer (B) is connected to the negative terminal of a battery (E) through a medium of a manual switch (SW) operated by an alarm signaling setting knob (23) while the other terminal is connected to a first stationary contact plate (22).

A further explanation will be made referring particularly to FIGS. 1, 3 and 4.

The first stationary contact plate (22) is disposed between the case (1) and the hour detecting wheel (17) and fixed on the case (1).

The tubular boss of the hour wheel (12) extends through the center hole of the first stationary contact plate (22). The hour detecting wheel (17) is made of electric conductive material and has, on its bottom face, three first projections (17*a*) arranged on a circle at an equal angular interval, and on its upper face, three second projections (17*b*) on three different circles at an equal angular interval, therefore, the hour detecting wheeel (17) is always electrically connected with the first stationary contact plate (22) and horizontally retained by the contact of the first projections (17*a*) with the first stationary contact plate (22).

An hour switch plate (24) is fixed on the upper face of the hour wheel (12) which is made of plastics and disposed above the hour detecting wheel (17). The hour switch plate has upwardly extending slide contact piece (24*a*) being always in sliding contact with the minute detecting wheel 16 made of electric conductive material and three downwardly projecting contact pieces arranged corresponding to the second projections (17*b*) of the hour detecting wheel (17) on three different circles at an equal angular interval, each projection (24*b*) extending through the holes on the hour wheel (12) as far as the tips of the projections (24*b*) are almost in the plane of the bottom face of the hour wheel (12).

Normally, the second projections (17*b*) of the hour detecting wheel (17) slide on the bottom face of the hour wheel (12) so that the switch plate (24) and the hour detecting wheel (17) are electrically disconnected. The projections (24*b*) and the second projections (17*b*) of the hour detecting wheel come in contact once every twelve hours at a predetermined relative phase. This contact is maintained for a fixed period of time.

Figure 3:
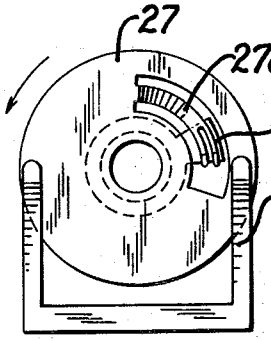
Figure 5:
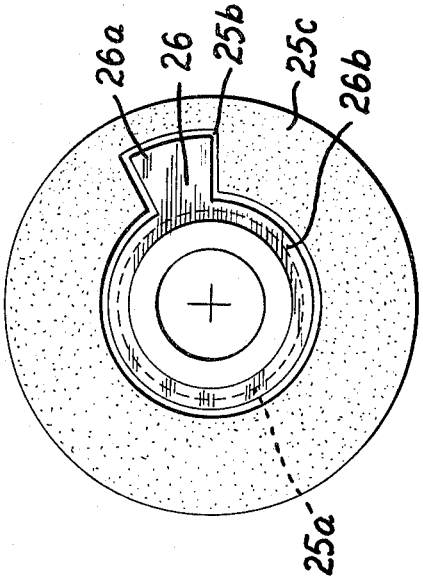
Figure 6:
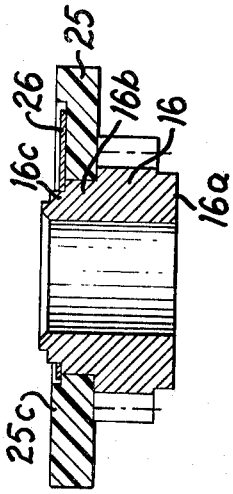
FIG. 6 is a sectional view of FIG. 5.
Figure 4:
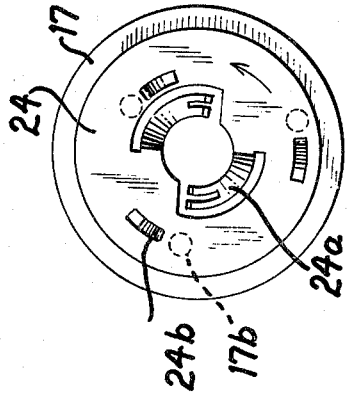

Referring now to FIGS. 3, 5 and 6, an explanation will be made on the construction of a minute detecting mechanism.

The minute detecting wheel (16) has a sliding contact face (16*a*), a first step (16*b*) and a second step (16*c*) on its boss. A sectoral contact plate (26) made of electric conductive material has a sectoral segment (26*a*) and a ringed segment (26*b*). An insulating disk (25) has hole (25*a*) at the center to fit on the first step (16*b*) of the minute detecting wheel (16) and a recess (25*b*) to fit in the sectoral contact plate (26) on the upper face. The depth of the recess (25*b*) is a little less than the height of the first step (16*b*) of the minute detecting wheel. Those constituents, the minute detecting wheel (16), the sectoral switch plate (26) and the insulating disk (25), are assembled by fitting the insulating disk (25) and the sectoral switch plate (26) on the first and second steps (16*b*) and (16*c*), respectively, in the order of the insulating disk and the sectoral contact plate and securing by caulking the upper surface of the second step (16*c*).

The insulating disk (25) will not move relative to the minute detecting wheel (16) constrained by the engagement of the recess (25*b*) with the sectoral segment (26*a*) of the sectoral contact plate (26).

The length of the first step (16*b*) being larger than the thickness of the insulating disk (25), the insulating disk (25) will not be stressed by the strength applied by caulking to fix the sectoral switch plate (26) to the second step (16*c*). Thus, the minute detecting wheel (16) and the sectoral switch plate (26) are electrically connected.

On the minute wheel (9) made of plastics, there is fixed minute switch plate (27) having a slide contact piece (27*a*) extending downwardly through a hole on the minute wheel (9) so as to make sliding contact with the sectoral switch plate (26). Normally, the slide contact piece (27*a*) slides on the surface (25*c*) of the insulating disk (25) coming in contact with the sectoral segment (26*a*) of the sectoral switch plate (26) once every hour. On the middle frame (2), there is fixed a second stationary contact plate (28), one end of which is always in sliding contact with the upper face of the minute switch plate (27) and the other end of which is connected to the positive terminal of the battery (E).

Although alarm signaling time is indicated digitally, the phase of the hour detecting wheel (17) is determined analogically as the hour detecting wheel (17) and the minute detecting wheel (16) are directly engaged with the alarm signaling time setting wheel (18), therefore, even if alarm signaling time is set on the time near the hour such as 55 minute when the hour indication is almost to change, alarm signaling will be performed precisely on the preset alarm signaling time as the hour detecting wheel (17) is turned analogically to the phase corresponding to 55 minutes only if the hour switch plate (24) is so designed as to be in contact with the hour detecting wheel (17) for less than one hour, for instance 30 minutes, even if the minute switch plate (27) and the sectoral switch plate (26) are arranged so as to keep contact with each other for a fixed period of time such as 5 minutes or 10 minutes.

The following explanation is concerned with performance of the mechanism.

The minute alarm signaling time indicating wheel (20) is rotated against the checking force applied by the click stopping spring (29) on the locking wheel (20*b*) by the alarm signaling time setting wheel (18) through the third pinion (18*c*) engaging with the minute alarm signaling time indicating wheel (20) by the knob (19). The minute alarm signaling time indicating marks (20*c*) appear in the opening (30*a*) click-stopping at every mark, 5, 10, 15, . . . , according to the click-stopping motion of the alarm signaling time indicating wheel (20).

When the minute alarm signaling time indicating mark (20*c*) changes from 55 to 00 or from 00 to 55, the hour alarm signaling time indicating wheel (21*a*) is turned for 30 degrees corresponding to the interval of one hour, such as from 1 o'clock to 2 o'clock or from 1 o'clock to 12 o'clock, by the place advancing teeth engaging with the gear (21*a*). Alarm signaling time is set observing the alarm signaling time marks (20*c*) and (21*b*) appearing in the opening (30*a*).

The minute detecting wheel (16) and the hour detecting wheel (17) also are rotated by the alarm signaling time setting wheel (18) simultaneously with the minute alarm signaling time indicating wheel (20) and the hour alarm signaling time indicating wheel (21) as the detecting wheels (16) and (17) are engaged with the first pinion (18*a*) and the second pinion (18*b*) of the alarm signaling time setting wheel (18), respectively. Accordingly, the phases of the sectoral switch plate (26) fixed on the minute detecting wheel (16) and the three second projections (17*b*) provided on the upper face of the hour detecting wheel (17) are determined simultaneously with alarm signaling time setting.

The alarm signaling mechanism is completely set by lastly turning on the alarm setting knob (23) to close the manual switch (SW). However, the buzzer (B) will not be actuated at this moment as the sectoral switch plate (26) and the slide contact piece (27*a*) of the minute switch plate or the second projections (17*b*) of the hour detecting wheel and the projections (24*b*) of the hour switch plate are not electrically connected yet. As time passes, the gear train for time indication is driven by a motor rotating the minute wheel (9) and the hour wheel (12) at the rates of one turn per one hour and one turn per twelve hours, respectively, so that the minute switch plate (27) and the hour switch plate (24) fixed on the minute wheel (9) and the hour wheel (12), respectively, are rotated at the rates given above.

Although the detecting wheels (16) and (17) are urged to turn by frictional force introduced by sliding contact of rotating minute switch plate (27) and the hour switch plate (24) with the minute detecting wheel (16) and the hour detecting wheel (17), respectively, the detecting wheels (16) and (17) are maintained at the present phases being constrained by the click-stopping spring (29) working on the locking wheel (20*b*) of the minute alarm signaling time indicating wheel (20). The sliding contact piece (27*a*) of the minute switch plate (27) comes in contact with the sectoral switch plate (26) once every hour in accordance with the rotation of the minute wheel (9) and yet the buzzer will not be actuated as the second projection (17*b*) of the hour detecting wheel (17) has not come in contact with the hour switch plate (24). Finally when the contact between the slide contact piece (27*a*) of the minute switch plate (27) and the sectoral switch plate (26) and between the second projections (17*b*) of the hour detecting wheel (17) and the hour switch plate (24) is attained simultaneously, while the contact between the projections (17*b*) and the projections (24*b*) of the hour switch plate (24) is maintained for a period of twenty to forty minutes, the buzzer (B) is actuated as the electric circuit; the first stationary contact plate (22)—the hour detecting wheel (17)—the hour switch plate (24)—the minute detecting wheel (16)—the sectoral switch plate (26)—the minute switch plate (27)—the second stationary switch plate (28) is connected all through.

The buzzer (B) keeps buzzing as long as the slide contact piece (27*a*) of the minute switch plate is in sliding contact with the secotral segment (26*a*). The buzzing can be optionally stopped by manually turning off the alarm setting knob (23). The buzzing period may be optionally determined by properly designing the dimension of the sectoral segment (26*a*).

The performance of the gear train for time indication has been explained partly hereinbefore.

The following explanation is concerned with the performance of the gear train in time indication adjustment.

Rotation of the time indication adjusting wheel (14) by the knob (15) is transmitted to the minute wheel (9) and the hour wheel (12) through the intermediate hour wheel (11) and its pinion (11*a*) and also to the intermediate spindle (7) through the minute wheel (9) and the pinion (7*a*). At this time, the minute detecting wheel (16) and the hour detecting wheel (17) are maintained at their preset phases being indirectly constrained by the click-stopping spring working on the locking wheel (20*b*). Rotation of the intermediate spindle (7) urges the intermediate wheel (8) to rotate through the friction coupling means comprising the leaf spring (32), however, the intermediate wheel (8) is restrained by the torque of the motor introduced through the pinion (5*a*) of the second wheel (5) as the torque of the motor exceeds that of the friction coupling.

Thus the phases of the minute hand (10) and the hour hand (13) are adjusted precisely to indicate correct time by knob (15) without unnecessarily affecting the alarm signaling time setting.

Figure 7:
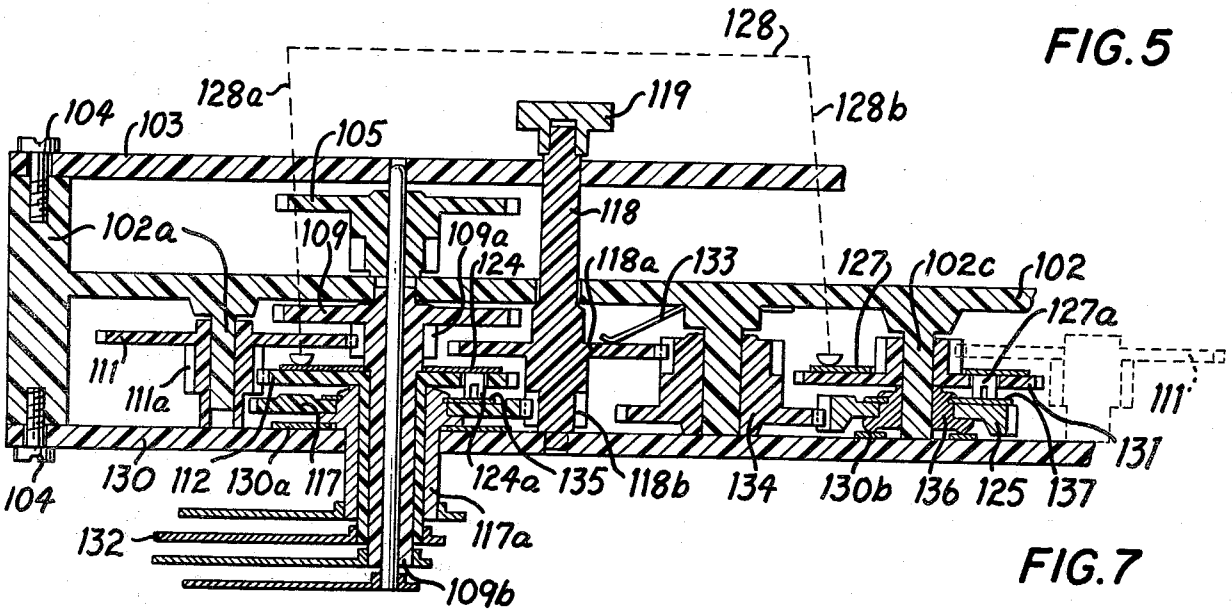
FIG. 7 is a sectional view of a second embodiment according to the present invention.

Referring now to FIG. 7, explanation will be made of the second embodiment of the invention.

A cover (103) and a printed circuit board (130) are fastened to a projection (102*a*) provided at the left end of a middle frame (102) by means of screws (104).

The following explanation is concerned with a gear train for the time indicating mechanism.

A second wheel (105), an intermediate wheel (not shown) and an intermediate spindle (not shown) are constituted similarly to those of the first embodiment. A pinion (109*a*) of a minute wheel (109) engaging with the pinion on the intermediate spindle is disposed on the tubular boss (109*b*) of the minute wheel (109). An hour wheel (112) is engaged with a pinion (111*a*) on an intermediate hour wheel (111).

The intermediate wheel (not shown) is engaged with a second minute wheel (131) rotatably fitted on a stud (102*c*) provided on the middle frame (102) and with a time indication adjusting wheel provided similarly to that of the first embodiment. The intermediate hour wheel (111) illustrated by dotted lines and engaging with the second minute wheel (131) serves similarly to the intermediate hour wheel of the first embodiment. The rotating rate of the second minute wheel (131) is quite identical with that of the minute wheel (109).

Explanation on the other construction and performances of the mechanism will be omitted as they are quite identical with those of the first embodiment.

The following explanation is concerned with a gear train of the alarm signaling mechanism.

The minute detecting wheel (125) is rotatably fitted on the stud (102*c*) provided on the middle frame (102) between the second minute wheel (131) and the printed circuit board (130). The hour detecting wheel (117) is disposed between the hour wheel (112) and the printed circuit board (130). A first tubular boss (117*a*) made of electric conductive material of the hour detecting wheel (117) is rotatably fitted in and extending through a hole on the printed circuit board (130) and fixedly provided with an index (132) at the end. An alarm signaling time setting wheel (118) has a first pinion (118*a*) and a second pinion (118*b*) engaging with the hour detecting wheel (117). An alarm signaling time setting knob (119) is fixed at the end of the alarm signaling time setting wheel (118). The alarm signaling time setting wheel (118) is controlled by a fixed frictional force provided by a friction piece (133) fixed to the middle frame at one end and pressed against the upper face of the first pinion (118*a*). The first pinion (118*a*) is engaged with the minute detecting wheel (125) through an idle wheel (134).

The following explanation is concerned with the construction of the alarm signaling time detecting mechanism.

The printed circuit board (130) has an annular first pattern (130*a*) connected to one terminal of the buzzer (B) and a second pattern (130*b*) connected to the positive terminal of a battery (B). The hour detecting wheel (117) made of electric nonconductive material and a first sectoral switch plate (135) are so fixed on the electric conductive first tubular boss (117*a*) that the first sectoral switch plate (135) and the first tubular boss (117*a*) are electrically connected. The bottom face of the first tubular boss (117*a*) is always in sliding contact with the first pattern (130*a*). On the hour wheel made of plastics, there is fixed an hour switch plate (124) having a slide contact piece (124*a*) normally sliding on the face of the hour detecting wheel (117) and coming in electric contact with the first sectoral switch plate (135) once every turn of the hour wheel (112). A second electric conductive tube (136) is disposed on the second pattern (130*b*) so as to keep electric contact with the second pattern (130*b*). The minute detecting wheel (125) made of electric nonconductive material and a second sectoral switch plate (137) are fixed on the second electric conductive tube (136) by means of caulking so that the second sectoral switch plate (137) and the second electric conductive tube (136) are electrically connected.

A minute switch plate (127) is fixed on the second minute wheel (131) made of plastics. The minute switch plate (127) has a slide contact piece (127*a*) extending downwardly through a hole on the second minute wheel (131). Normally, the slide contact piece (127*a*) slides on the minute detecting wheel (125) and comes in contact with the second sectoral switch plate (137) once every hour. A first elongation (128*a*) and a second elongation (128*b*) of a stationary contact plate (128) of a forked shape are always in sliding contact with the hour switch plate (124) and the minute switch plate (127), respectively, so that the hour switch plate (124) and the minute switch plate (127) are electrically connected.

The following explanation is concerned with the performance of the abovementioned mechanisms.

The rotation of the alarm signaling time setting wheel (118) by means of the knob (119) is transmitted to the minute detecting wheel (125) and the hour detecting wheel (117) by the first pinion (118*a*) and the second pinion (118*b*), respectively while observing the indication of the index (132) fixed on the hour detecting wheel to set an alarm signaling time, so that the phases of the minute detecting wheel (125) and the hour detecting wheel (117), that is, the phases of the second sectoral switch plate (137) and the first sectoral switch plate (135) on the hour detecting wheel, are determined. Alarm setting is completed by finally turning on the switch knob 23 to close the manual switch (SW). The buzzer (B) will not be actuated before the minute switch plate (127) and the hour switch plate (137) and the first sectoral switch plate (135), respectively, are at the predetermined alarm signaling time. Explanation of the performance of the other elements will be omitted as they are quite identical with those of the first embodiment except the electric circuit according to the second embodiment is constituted in the order of the first pattern (130*a*)—the first electric conductive tube (117*a*)—the first sectoral switch plate (135)—the hour switch plate (124)—the stationary contact plate (128)—the minute switch plate (127)—the second sectoral switch plate (137)—the second electric conductive tube (136)—the second pattern (130*b*) at the predetermined alarm signaling time.

Although the invention has been described in its preferred forms with a certain degree of particularity, it is to be understood that the present disclosure may be changed in the details of construction and arrangement of parts without departing from the spirit and the scope of the invention, for instance, the invention is capable of being practiced in a time signaling clock which produces a time signal at a fixed time by fixing the phases of the detecting wheels of the embodiments hereinbefore described.

Although alarm signaling time is detected both at minute and hour places in the preferred embodiments, the object of the invention can be substantially attained by detecting alarm signaling time only by the hour detecting mechanism, omitting the minute detecting mechanism.

According to the invention, the slide switch is simply constructed by employing an electric conductive tube as a part of the electric circuit and the detecting switches also are simply constructed by integrating the minute and the hour detecting switches on a common spindle as in the first embodiment.

We claim:

1. In combination, a time detecting switch for connection in series with the electrically actuated time signalling circuit of a time signalling clock having a time wheel and a detecting wheel both rotatably mounted coaxially, and a phase detecting type slide switch disposed between the time wheel and the detecting wheel, comprising: one of said wheels comprising an electrically conductive hub having a flange with a radial contacting surface at one end of the hub, an insulating disk and a sectoral switch plate around said hub, the disk being sandwiched between said plate and said flange and the plate being mechanically and electrically connected to the other end portion of said hub facing the other wheel; the other of said wheels having a sliding contact for contacting said sectoral plate; and wherein the radial contacting surface of said flange is configured to maintain uninterrupted continuous sliding contact with the time signalling circuit of the clock.

2. The combination as set forth in claim 1, wherein an hour detecting wheel and a minute detecting wheel are provided corresponding to an hour wheel and a minute wheel, respectively, at least said minute detecting wheel having said electric conductive hub, insulating disk and sectoral switch plate, and said wheels being disposed coaxially in order of the hour detecting wheel, the hour wheel, the minute detecting wheel and the minute wheel.

3. The combination as set forth in claim 1, having an hour detecting wheel corresponding to an hour wheel, said hour detecting wheel comprising said electric conductive hub, the insulating disk and the sectoral switch plate, and having a tube connected to the hub and an index fixed on the tip of said tube.

4. The combination according to claim 1; wherein said sectoral plate is inset in said insulating disk and substantially flush with the surface thereof.

5. In a time signalling clock having an electrically actuatable time signal circuit, at least one rotatable time wheel, at least one rotatable detecting wheel and at least one time detecting switch connected in series with the time signal circuit: the improvement wherein the switch comprises a phase detecting slide switch disposed between the time and detecting wheels which are coaxially mounted for rotation; wherein one of said time and detecting wheels comprises an electrically conductive hub having a flange at one end having a radial contact surface, an electrically conductive sectoral plate mechanically and electrically connected to said hub and facing the other wheel, an insulating disk disposed between said sectoral plate and said flange, and means connected to the time signal circuit to establish continuous uninterrupted contact with said radial contact surface of the flange; and wherein the other of said time and detecting wheels comprises a slide contact for contacting said sectoral plate at the desired signal time to thereby effect actuation of the time signal circuit.

6. A time signalling clock according to claim 5; wherein said sectoral plate is inset in said insulating disk and substantially flush with the surface thereof.

7. A time signalling clock according to claim 5; further including an hour wheel, a minute wheel, an hour detecting wheel and a minute detecting wheel, at least said minute detecting wheel having said hub, insulating disk and sector plate construction, and wherein the wheels are disposed coaxially in the order of hour detecting wheel, hour wheel, minute detecting wheel and minute wheel.

* * * * *